US006612571B2

(12) United States Patent
Rider

(10) Patent No.: US 6,612,571 B2
(45) Date of Patent: Sep. 2, 2003

(54) SHEET CONVEYING DEVICE HAVING MULTIPLE OUTPUTS

(75) Inventor: Jason P. Rider, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 21 days.

(21) Appl. No.: 10/003,084

(22) Filed: Dec. 6, 2001

(65) Prior Publication Data

US 2003/0107169 A1 Jun. 12, 2003

(51) Int. Cl.[7] ..... B65H 39/10

(52) U.S. Cl. ..... 271/279; 271/298; 271/300; 271/288

(58) Field of Search ..... 271/279, 298, 271/300, 288; B65H 39/10, 29/00

(56) References Cited

U.S. PATENT DOCUMENTS

| | | | | | |
|---|---|---|---|---|---|
| 4,834,360 | A | * | 5/1989 | Acquaviva | 271/3.04 |
| 4,925,176 | A | * | 5/1990 | Acquaviva | 271/3.03 |
| 5,114,306 | A | * | 5/1992 | Sjogren et al. | 414/790.4 |
| 5,226,780 | A | * | 7/1993 | Sjogren et al. | 414/790.4 |
| 5,461,469 | A | * | 10/1995 | Farrell et al. | 399/407 |
| 5,570,172 | A | | 10/1996 | Acquaviva | 355/323 |
| 5,597,156 | A | | 1/1997 | Claassen | 271/225 |
| 5,628,042 | A | | 5/1997 | Less | 399/78 |
| 5,887,864 | A | | 3/1999 | Stevens et al. | 270/52.07 |
| 6,131,900 | A | | 10/2000 | Hou | 271/184 |
| 6,132,352 | A | * | 10/2000 | Rider | 493/419 |
| 6,158,735 | A | | 12/2000 | Cote et al. | 271/302 |
| 6,168,153 | B1 | | 1/2001 | Richards et al. | 271/227 |
| 6,305,680 | B1 | | 10/2001 | Allen et al. | 270/45 |

* cited by examiner

*Primary Examiner*—Donald P. Walsh
*Assistant Examiner*—Kenneth W Bower
(74) *Attorney, Agent, or Firm*—Joseph M. Young

(57) ABSTRACT

A sheet conveying device having multiple directional outputs with multiple registration options having no fixed registration wall for sequencing single sheets or two approximately identical sheets arriving in a two-up configuration, includes a first, second, third, and fourth pairs of rolls. The first pair of rolls and the second pair of rolls rotate about a first shaft, which is rotated by a first servomotor. The third pair of rolls rotate about a second shaft, which is rotated by a second servomotor, wherein the shaft is oriented at an angle approximately 90° relative to the first shaft. The fourth pair of rolls rotate about a third shaft oriented at an angle approximately 90° relative to the first shaft and approximately parallel to the second shaft, and a third servomotor operably connected to the third shaft rotates the third shaft.

20 Claims, 8 Drawing Sheets

SHEET CONVEYING DEVICE HAVING MULTIPLE OUTPUTS

BACKGROUND AND SUMMARY

This invention relates to high-speed printers and more specifically, it relates to a sheet-conveying device that can output paper in multiple directions.

Electrophotographic printing and reproduction devices are well known. Typically, a photoconductive member is charged to a uniform potential and thereafter exposed to a light image of an original document to be reproduced. The exposure discharges the photoconductive member in areas corresponding to the background of the document being reproduced and creates a latent image on the photoconductive member. Alternatively, in a laser-beam printer or the like, a light beam is modulated and used to selectively discharge portions of the photoconductive member in accordance with image information. With either type of apparatus, the latent image on the photoconductive member is visualized by developing the image with a developer powder commonly referred to as "toner." Most systems employ developer, which comprises both charged carrier particles and charged toner particles that triboelectrically adhere to the carrier particles. During development of the latent image, the toner particles are attracted from the carrier particles by the charged pattern of image areas on the surface of the photoconductive member to form a visualized toner image on the photoconductive member. This toner image is then transferred to a recording medium such as paper or the like for viewing by an end user. Typically, the toner is fixed to the surface of the paper through the application of heat and pressure.

Following the successful reproduction of one or more documents in this fashion, it is often desirable to perform one or more of a variety of post-processing functions on the printed documents. For example, a piece of paper that has received an image may need to be decurled, embossed, perforated, slit, rotated, or stacked. The user may also want to use a variety of finishing applications such as staplers, tape binders, perfect binders, stitchers, and signature booklet makers. These applications require output to be in a particular orientation for proper operation of the equipment.

Accordingly, a need has been recognized for post-image transfer modules capable of performing any of a wide variety of post-processing functions using the same base document handling hardware, but also releasably receiving one or more post-processing modules that perform particular post-processing functions.

Further, some printing systems may output sheets two at a time in addition to, or instead of one at a time. This is known in the art as "two-up" or "2-up" delivery. One way to increase the speed of the printer, without increasing the speed of the xerographic module, is to print two-up. Printing two-up involves printing two images side-by-side on the same large sheet (11×17 for example). Then, after the images are transferred to the sheet, the sheet is fed into a slitter module, which slits the sheet into two smaller sheets (8.5×11). This method effectively doubles the output speed of a printer. The images on each side of the sheet can either be duplicates or prints from separate jobs.

However, printing two-up creates problems after the slitting has occurred because now there are two sheets traveling side-by-side through the paper path. In order to get the two sheets into a single stream so that they can be handled by conventional finishing equipment, a sheet-conveying device having multiple outputs is often used. A traditional sheet conveying device having multiple outputs accepts the two sheets on input, slows them down until they hit a fixed wall, and then drives the sheets out 90° from the input direction. Thus, the sheets exit the sheet-conveying device having multiple outputs one after the other.

Problems exist with traditional sheet sequencers and path controllers. First, traditional sheet sequencers often require manual setups of the fixed wall so that the sheet conveying device having multiple outputs can handle the correct sheet size and weight. Thus, varying paper sizes or weights in the same job cannot be handled reliably. Second, using a fixed registration wall causes the output of the sheet conveying device having multiple outputs to be edge registered. A large number of finishing devices request center registered input, and thus could not be supported with the existing system. Third, existing sheet-conveying device having multiple outputs have been traditionally unreliable. Because of their manual adjustments, they often must be tweaked between jobs for the prints to run properly. Also, because the sheets are being pushed into a registration wall, there exists the possibility of sheet damage, especially in lightweight papers.

Further, regardless of whether two-up printing is used, various factors go into the consideration of their printing system set up. One customer may want the printing and finishing modules to be arranged in a single line. Others may way want an L-shape or reverse L-shape. It would be useful for a customer to have greater flexibility when setting up a new printing system or when modifying an old printing system, such as by adding new modules or replacing old ones.

Embodiments include a method of changing the direction of travel of first and second sheets exiting a device in a two-up configuration without using a registration wall, which includes sensing a trailing edge of the first sheet and a trailing edge of the second sheet; accelerating the first sheet in a first direction with a first pair of drive rolls; accelerating the second sheet in the first direction in tandem with the first sheet with a second pair of drive rolls; decelerating the first sheet and the second sheet until each of the first sheet and the second sheet substantially stop travelling in the first direction; retracting the first pair and second pair of drive rolls; extending a third pair and a fourth pair of drive rolls; accelerating the first sheet to a first speed in a second direction oriented approximately 90° to the first direction with the third pair of drive rolls; accelerating the second sheet to a second speed in a third direction with the fourth pair of drive rolls.

Other embodiments include a sheet conveying device having multiple outputs for sequencing two approximately identical sheets, each sheet having a leading edge and a trailing edge, wherein the sheets arrive in a two-up configuration, and wherein the sheet conveying device having multiple outputs has no registration wall, which includes a first pair of rolls; a second pair of rolls; a first shaft about which the first pair of rolls and the second pair of rolls rotate; a first servomotor operably connected to the first shaft, wherein the first servomotor rotates the first shaft; a third pair of rolls; a second shaft about which the third pair of rolls rotate, the second shaft oriented at an angle approximately 90° relative to the first shaft; a second servomotor operably connected to the second shaft, wherein the second servomotor rotates the second shaft; a fourth pair of rolls; a third shaft about which the fourth pair of rolls rotate, the third shaft oriented at an angle approximately 90° relative to the first shaft and approximately parallel to the second shaft; a third servomotor operably connected to the third shaft, wherein the third servomotor rotates the third shaft.

Still other embodiments include a method of changing the direction of travel of a sheet exiting a device without using a registration wall, and without rotating the sheet, which includes sensing a trailing edge of the sheet; accelerating the sheet in a first direction with a first pair of drive rolls; decelerating the sheet using the first servomotor until the sheet substantially stops travelling in the first direction; retracting the first pair of drive rolls; extending a second pair of drive rolls; and accelerating the sheet in a second direction oriented approximately 90° to the first direction with the second pair of drive rolls.

Still other embodiments include a multi-path sheet conveying device having multiple outputs, which includes a first sensor located for detecting when a trailing edge of a first sheet passes the first sensor; a controller operably connected to the first sensor; a first shaft; a first pair of rolls rotatably connected to the first shaft; a first servomotor operably connected to the first shaft and to the controller, wherein the first servomotor rotates the first shaft; a second shaft oriented at an angle approximately 90° relative to the first shaft; a second pair of rolls rotatably connected to the second shaft; and a second servomotor operably connected to the second shaft and to the controller, wherein the second servomotor rotates the second shaft.

BRIEF DESCRIPTION OF THE DRAWINGS

The invention will be described in detail herein with reference to the following figures in which like reference numerals denote like elements and wherein.

DETAILED DESCRIPTION OF EMBODIMENTS

Figure 1:
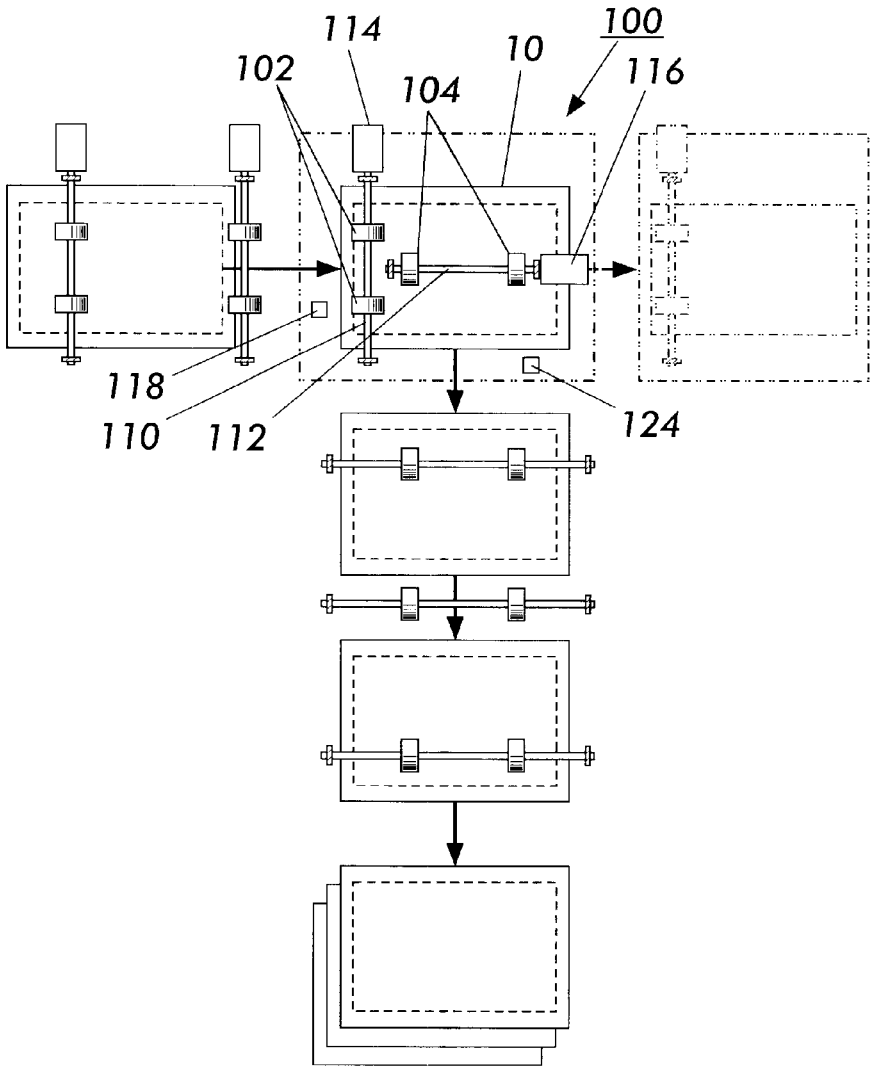
FIG. 1 is a schematic overhead view of an embodiment of a sheet-conveying device having multiple outputs.
Figure 2:
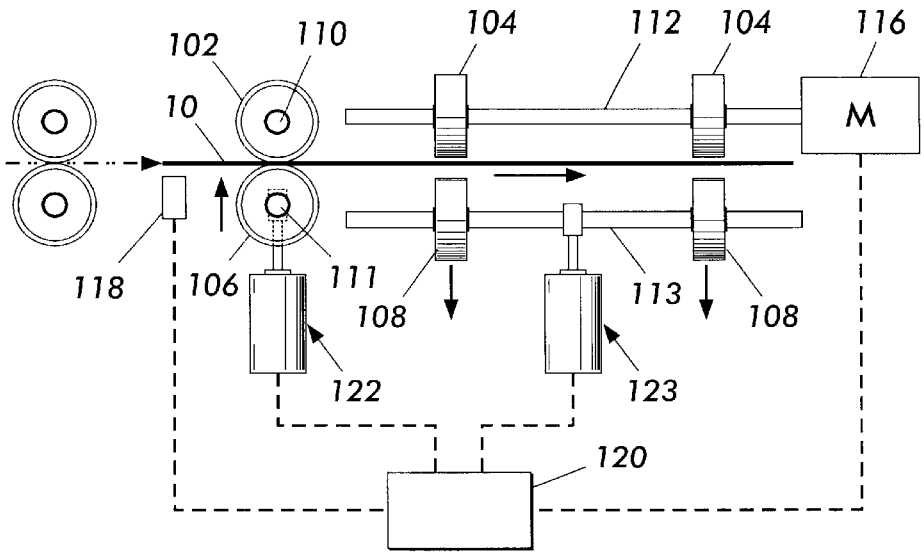
FIG. 2 is a schematic elevated right side view of the sheet-conveying device of FIG. 1 with the 0° idler rolls engaged.
Figure 3:
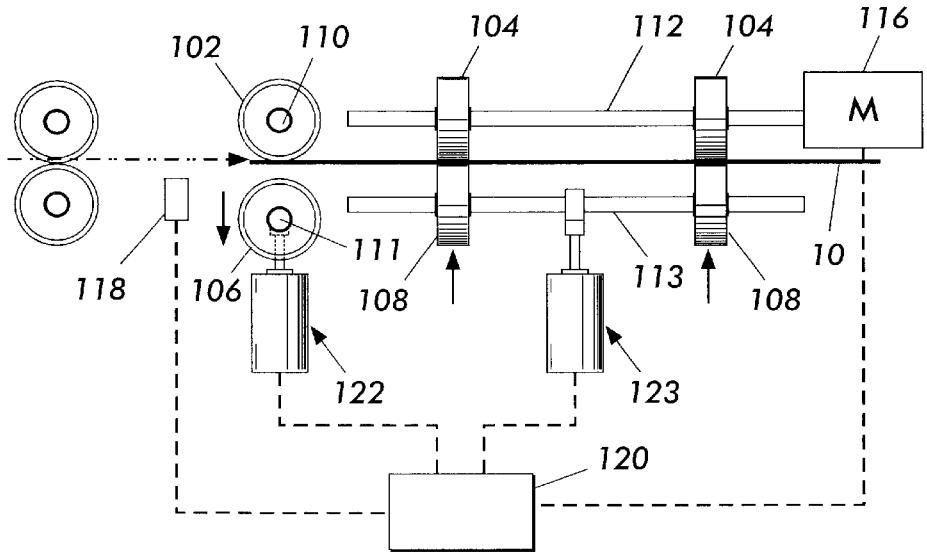
FIG. 3 is a schematic elevated right side view of the sheet-conveying device of FIG. 1 with the 90° idler rolls engaged.

While the present invention will be described with reference to specific embodiments thereof, it will be understood that the invention is not to be limited to these embodiments. On the contrary, it is intended that the present invention cover all alternatives, modifications, and equivalents as may be included within the spirit and scope of the invention as defined by the appended claims. Other aspects and features of the present invention will become apparent as the description proceeds, wherein like reference numerals have been used throughout to designate identical elements. It is further noted that all references cited in this specification, and their references, are hereby incorporated by reference where appropriate for relevant teachings of additional or alternative details, features, and/or technical background.

In the following paragraphs, I have used the term paper generally for toner receivers. It will be apparent to those with skill in the art that other materials such as plastics, textiles, etc. are equivalent to paper for the purposes of this invention.

FIGS. 1–5 illustrate an embodiment of a sheet-conveying device 100. Embodiments of this sheet direction changer do not use a registration wall, and do not rotate the printed sheet. The multi-path sheet direction changer can be connected in series to the output of, for example, a printer. However, this embodiment can be connected to any device that outputs sheets of paper.

The embodiment of the sheet illustrated in FIGS. 1–5 includes two pairs of drive rolls (102, 104) and two pairs of idlers (106, 108). The first pair of drive rolls 102 are rotatably connected to a first shaft 110. The second pair of drive rolls 104 are rotatably connected to a second shaft 112. The idlers are in turn connected to shafts 111 and 113 respectively. Two digitally controlled servomotors (servos) (114, 116) drive the first 110 and second 112 shafts, thereby rotating the rolls. It should be noted that the rolls can be any type of roll. I have used cylindrical rolls in the drawings for this invention, but this should not be considered limiting as spherical or other rolls can be used with this invention.

As sheet 10 enters this embodiment of the multi-path sheet direction changer, it comes under control of the first servomotor 114, which will also be referred to as the 0° servo 114 for reference. The remaining servomotor will be referred to as the 90° servo 116. The drive roll pair 102 (and opposing idler pair 106) are located so that when the 0° servo 114 activates, each pair drives the incoming sheet into the sheet direction changer. A controller 120 starts and stops each of the servos.

Embodiments of the system also include a servo control sensor 118. The sensor 118 can be located on the output of the device feeding paper to the sheet direction changer to detect when the (trail edge) TE of the sheet 10 exits the previous device. The sensor can also be located on the sheet direction changer to detect when the TE of the sheet 10 enters the sheet direction changer. The sensor 118 is operably connected to the controller 120. This connection can be electrical, optical, or any other method wherein a signal can be sent to the controller 120. The controller 120 receives the signal from the sensor and determines when to accelerate and when to stop the 0° and 90° servos based upon the signal, knowledge of the paper size, and knowledge of the finishing device to which output is being sent.

Sheet size information can be provided to the controller 120 from operator input or from the sheet feeding tray or cassette selection, or other method. For example, the controller can be programmed to associate certain paper sizes with certain trays. For example, the controller 120 may have stored in its memory that tray 4 contains A4 paper. It would also have knowledge of the device to which the output is being sent. For example, the user could input what finishing device was attached. Given the tray number, the controller would know the paper size, and given the finishing device the controller would know what kind of registration was required. If the user, for example, selects tray 4 and an inserter for inserting, for example, cover stack into the stream, where the inserter required center registered input, the controller automatically stops and starts the servomotors to properly register A4 paper for the inserter.

After receiving information about position and size of the sheet, the controller 120 first sends a signal to the 0° servo 114 to match the output speed of the printer (or whatever other device delivering sheets to the sheet direction changer) so that there is less chance of damage to the paper or of a jam being created. The servo 114 accelerates the rotation of the shaft 110 thereby accelerating drive roll pair 102. Drive roll pair 102 form nips with idler pair 106. The 0° servo 114 accelerates drive roll pair 102 once the TE of the sheet is out of the previous nip in order to increase the inter-copy gap (ICG) between the sheets in the nip and the following pair of slit sheets. This is designed to give the multi-path sheet direction changer time to stop the two-up sheets and drive them out at an approximately 90° angle before the next pair of sheets enters. The controller 120 then signals the 0° servo 114 to stop the sheets in a position where they will be properly registered for output. Depending on the finishing device to be used, the sheets can be center, inboard (IB) or outboard (OB) registered. This is beneficial in that the multi-path sheet direction changer can then be used to input into any finishing device.

Once the sheet is in the correct stop position, the controller 120 sends a first signal to a first actuator 122 to retract the 0° idler pair 106 and a second signal to a second actuator 123 to extend the 90° idler pair 108. Any one of numerous types of actuators may be used to retract and extend the shafts (111, 113) to which the idlers are connected. There are multiple ways known in the art in which the extension and retraction of the idler rolls may be accomplished.

Figure 4:
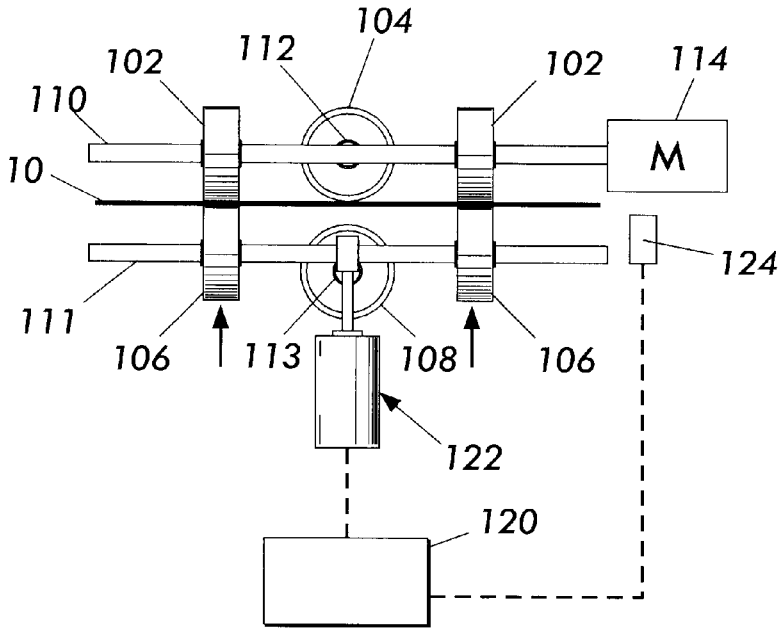
FIG. 4 is a schematic elevated front view of the sheet-conveying device of FIG. 1 with the 0° idler rolls engaged.
Figure 5:
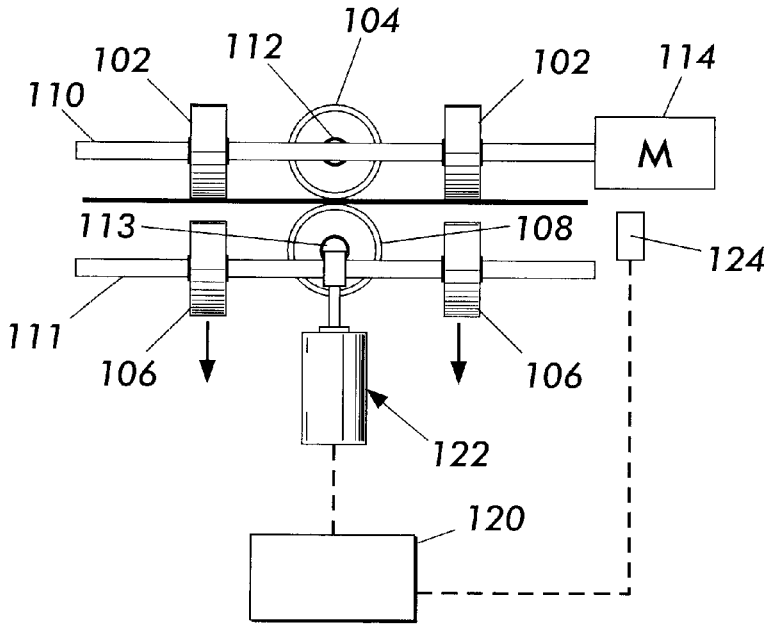
FIG. 5 is a schematic elevated front view of the sheet-conveying device of FIG. 1 with the 90° idler rolls engaged.
Figure 6:
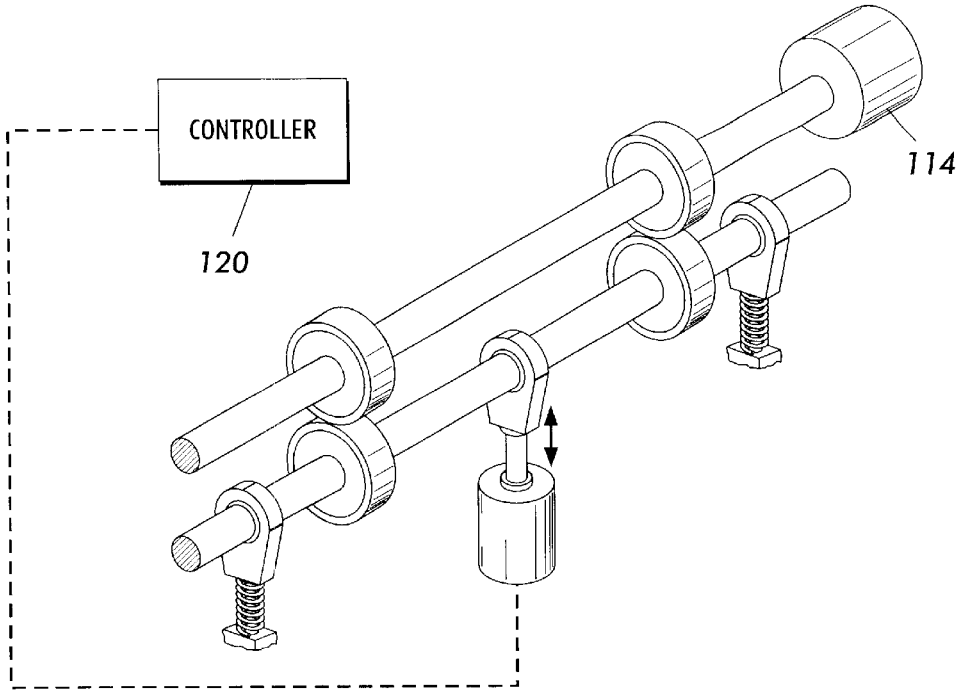
FIG. 6 is a schematic side view of an exemplary shaft and idler rolls in conjunction with a cam system.

For example, FIGS. 2–5 illustrate shafts 111 and 113, each connected to an arm connected to a solenoid. It is known in the art to use solenoids to hold idler rolls in a retracted state until they are needed. The solenoids (122, 123) in FIGS. 2–5 in turn are connected to the controller 120. FIG. 6 shows in more detail an embodiment of a solenoid mechanism for retracting/extending the idler rolls. FIG. 6 also shows a spring bias system, which causes the shaft connected an idler to extend into a position where nips are formed when power to the solenoid is cut. When the sheet 10 is in a desired registration position, the controller de-energizes the solenoid and the spring bias system engages the pair of idler rolls and causes nips to form between the drive rolls and the idler rolls. The fact that FIGS. 2–6 show the idlers raising to create a nip should not be considered limiting. The idlers could be lowered from above or extended in any other direction to form a nip. Further, the solenoid actuation system can be designed so that the idlers are engaged when the solenoid is energized and disengaged when the solenoid is de-energized.

Figure 7:
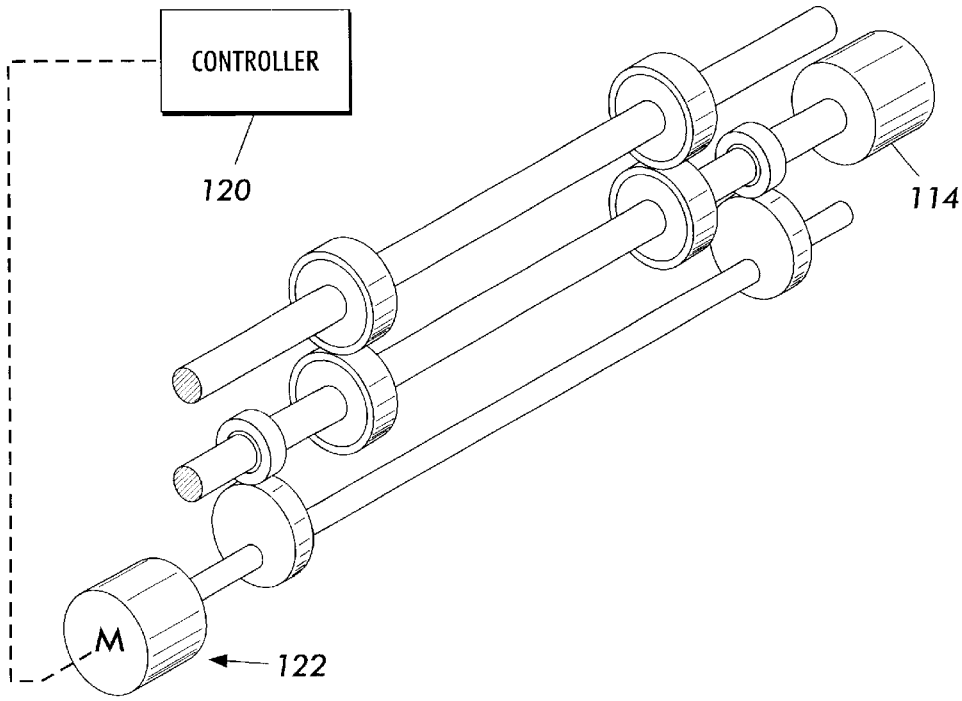
FIG. 7 is a schematic side view of an exemplary shaft and idler rolls in conjunction with a solenoid.

Further, the solenoid system shown and discussed is meant to be an exemplary embodiment of an actuating system. There are other methods for engaging and disengaging idlers that will be readily apparent to anyone reasonably skilled in the art. For example, it is also known in the art to use a cam mechanism, such as that shown in FIG. 7, to raise and lower each idler pair. As there are multiple ways known in the art to engage or disengage idler rolls, the methods disclosed herein should not be considered limiting.

After the 0° idler pair 106 have been retracted and the 90° idler pair 108 have been extended, the controller starts up the 90° servo 116. The servo 116 ramps drive roll pair 104 up to a speed that matches the input speed of the finishing equipment. The sheet 10 is then driven into the first nip in the finishing system where it now is under control of that nip. Once the TE of the sheet 10 exits the sheet direction changer, the controller 120 turns the 90° servo off.

A sensor 124 that is operably connected to the controller 120 informs the controller when the sheet 10 is exiting the sheet-conveying device. The second sensor 124 may be located at an exit point of the sheet direction changer as shown in FIGS. 1, 4, and 5 or the sensor 124 may be located at the entrance to the finisher. The sensor 124 can sense the TE or the lead edge of the paper as it passes. As soon as the sheet 10 is out from between the 0° nips, the controller 120 causes the 90° actuator 123 to disengage the 90° idler pair 108 while at the same time causing actuator 122 to reengage the 0° idler pair 106 and ramping up the 0° servo 114 to accept the next sheet entering the sheet direction changer.

FIGS. 8–12 illustrate another embodiment of a multi-path sequencer for use with two-up printing. The sheet-conveying device 200 having multiple outputs can be connected in series to the output of, for example, a converting module including a slitter. The slitter may alternately be used to slit incoming paper so that a large sheet may be turned into two smaller sheets. For example, it can be used to turn an 11×17 sheet into two 8.5×11 sheets. However, the converting module can allow large sheets to pass through intact. A converting module is meant to be exemplary of a device to which this embodiment may be connected, but this embodiment be connected to any device that outputs sheets in a two-up format.

The embodiment illustrated in FIGS. 8–12 includes four pairs of drive rolls (202, 204, 206, and 208) and four pairs of idlers (212, 214, 216, and 218). The first pair of drive rolls 202 and the second pair of drive rolls 204 are rotatably connected to a single first shaft 222. The third pair of drive rolls 206 are rotatably connected to a second shaft 224, and the fourth pair of rolls 208 are rotatably connected to a third shaft 226. Three digitally controlled servomotors (servos) (232, 234, 236) drive the first 222, second 224, and third 226 shafts, thereby rotating the rolls.

As two sheets enter the sheet conveying device having multiple outputs, they come under control of the first servomotor 232, which will also be referred to as the 0° servo for reference. The remaining servomotors will be referred to as 90° servos 234, 236. The drive roll pairs 202, 204 (and opposing idler pairs 212, 214) are located so that when the 0° servo activates, each pair drives one of the two incoming sheets into the sequencer. A controller 242 starts and stops each of the servos.

Embodiments of the system also include servo control sensor 244. The sensor 244 can be located on the output of the device feeding paper to the sequencer, most often a slitter for two-up prints, so as to detect when the (trail edge) TE of each of the sheets exits the previous device. The sensor 244 can also be located on the sequencer to detect when the TE of the sheets enters the sequencer. The sensor 244 is operably connected to the controller 242. This connection can be electrical, optical, or any other method wherein a signal can be sent to the controller. The controller 242 receives a signal from the sensor 244 and determines when to accelerate and when to stop the 0° and 90° servos based upon the signal, knowledge of the paper size (before or after slitting), and knowledge of the finishing device to which output is being sent. As noted with respect to the previously discussed embodiment there are myriad ways information regarding paper size and finisher type can be relayed to the controller.

After receiving information about position and size of the sheets, the controller first sends a signal to the 0° servo 232 to match the output speed of the slitter module so that there is less chance of damage to the paper or of a jam being created. The servo 232 accelerates the rotation of the shaft thereby accelerating drive roll pairs 202 and 204. Drive roll pairs 202 and 204 form nips with idler pairs 212 and 214. The 0° servo 232 accelerates drive roll pairs 202 and 204 once the TE of the sheet is out of the previous nip in order to increase the inter-copy gap (ICG) between the sheets in the nip and the following pair of slit sheets. This is designed to give the sheet conveying device having multiple outputs time to stop the two-up sheets and drive them out at an approximately 90° angle before the next pair of sheets enters. The controller then signals the 0° servo to stop the sheets in a position where they will be properly registered for output. Depending on the finishing device to be used, the sheets can be center, inboard (IB) or outboard (OB) registered. This is beneficial in that the sheet-conveying device having multiple outputs can then be used to input into any finishing device.

Once the two sheets are in the correct stop position, the controller 242 sends a signal to the 0° actuator 245 to retract the 0° idler pairs (212, 214). At the same time it sends a signal to the actuator 246 to extend the first 90° idler pair 216, and it sends a signal to the actuator 247 to extend the second 90° idler pairs 218. Any one of numerous types of actuators may be used to retract and extend the shafts (222, 224, 226) to which the idlers are connected. As discussed with respect to the embodiment disclosed in FIGS. 1–5, there are multiple ways known in the art in which the extension and retraction of the idler rolls may be accomplished.

For example, FIGS. 9–12 illustrate the 0° 222 and 90° (224, 226) shafts, each connected to an arm connected to a solenoid. It is known in the art to use solenoids to hold idler rolls in a retracted state until they are needed. The solenoids (245, 246, 247) in FIGS. 9–12 in turn are connected to the controller 242. Again, FIG. 6 shows in more detail an embodiment of a solenoid mechanism for retracting/extending the idler rolls. FIG. 6 also shows a spring bias system, which causes the shaft connected an idler to extend into a position where nips are formed when power to the solenoid is cut. Again, the fact that FIGS. 9–12 show the idlers raising to create a nip should not be considered limiting.

Further, the solenoid system shown and discussed is meant to be an exemplary embodiment of an actuating system. There are other methods for engaging and disengaging idlers that will be readily apparent to anyone reasonably skilled in the art. For example, it is also known in the art to use a cam mechanism, such as that shown in FIG. 7, to engage and disengage each idler pair. As there are multiple ways known in the art to engage or disengage idler rolls, the methods disclosed herein should not be considered limiting After the 0° idlers have been retracted and the 90° idlers have been extended, the controller starts up the two 90° servos. The servo 234 that is closer to the output of the sheet conveying device having multiple outputs is ramped up to a higher speed than the servo 236 further from the output so that separation can be created between the two sheets. This is done to help ensure that there is sufficient time for the finishing system following the sheet-conveying device having multiple outputs to handle the two sheets separately. The servo 234 ramps drive roll pair 206 up to a speed that matches the input speed of the finishing equipment. The sheet 204 is then driven into the first nip in the finishing system where it now is under control of that nip. Servo 236 rotates drive roll pair 208 so that it pushes the sheet 206 which is further from the output at a slower speed until the lead edge (LE) of the sheet is close to the drive roll 206 nip. At this point servo 236 speeds up to rotate drive roll pair 208 faster until drive roll pair 208 matches the speed of drive roll pair 206. This creates a smooth transition of the sheet between the two nip pairs. The second sheet is then driven out of the nip between drive roll pair 208 and idler pair 218 into the finishing device. Once the TE of the second sheet is out of the sheet conveyer, both the 90° servomotors turn off.

Figure 8:
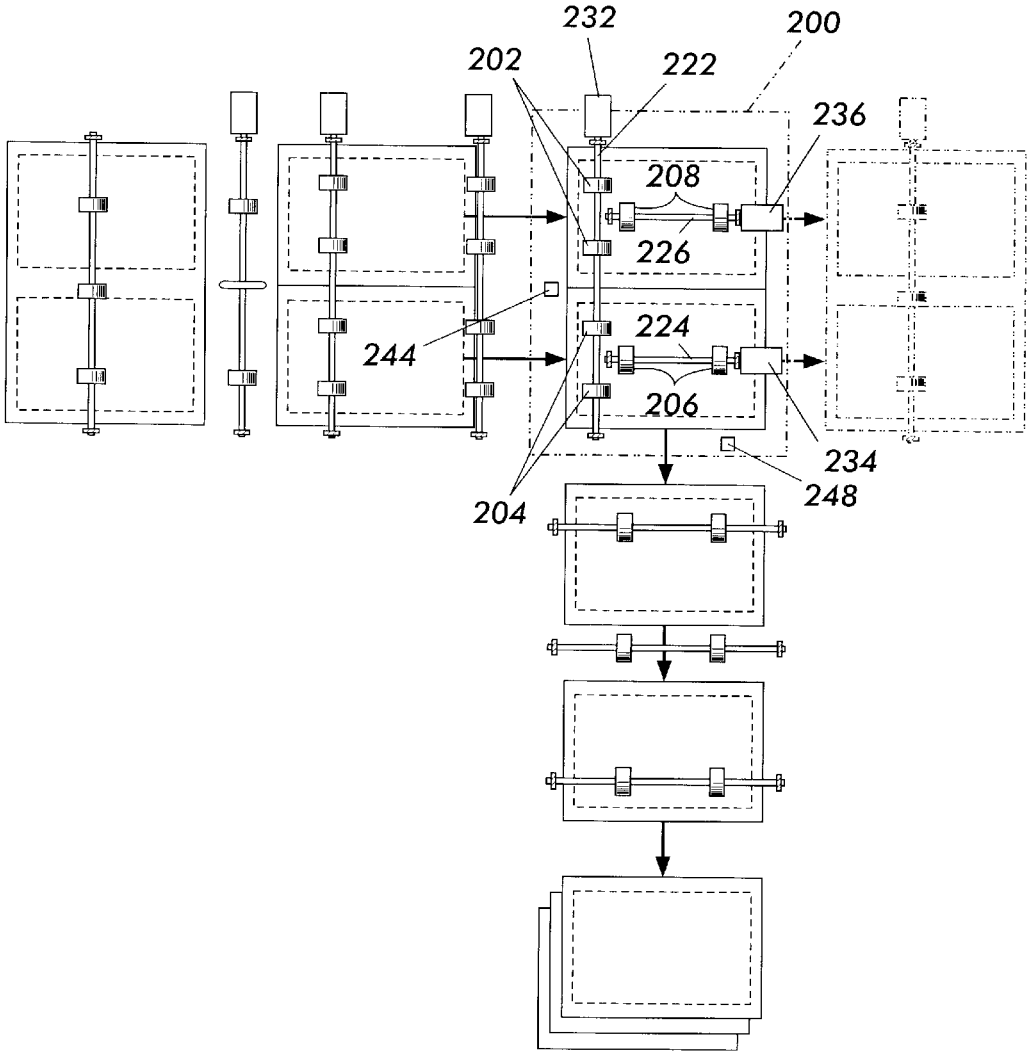
FIG. 8 is a schematic overhead view of another embodiment of a sheet-conveying device having multiple outputs.
Figure 9:
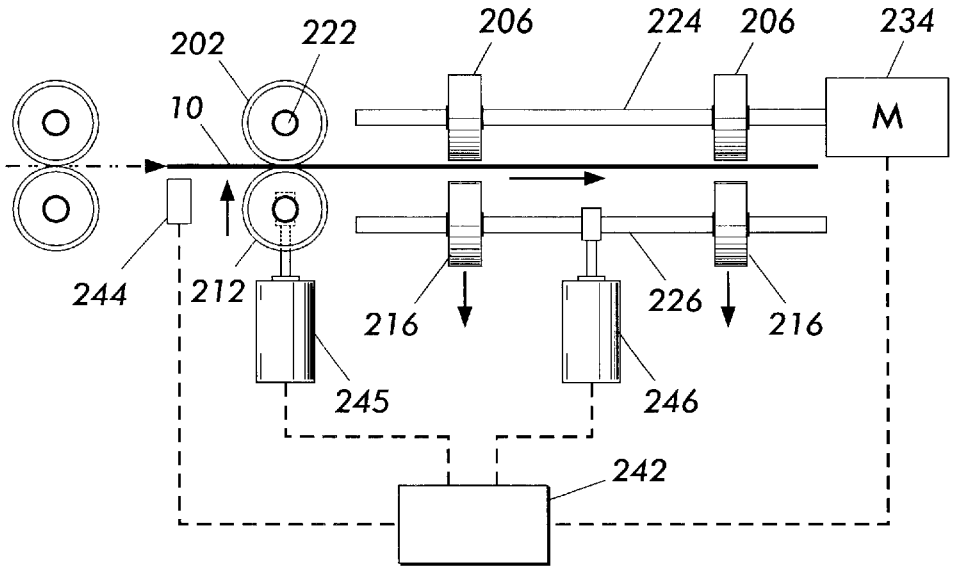
FIG. 9 is a schematic elevated right side view of the sheet-conveying device of FIG. 8 with the 0° idler rolls engaged.
Figure 10:
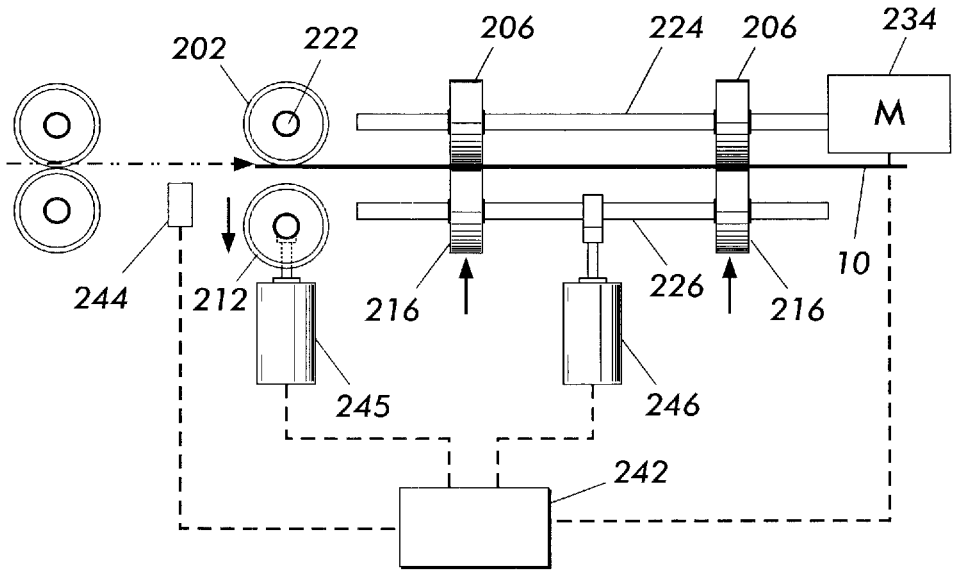
FIG. 10 is a schematic elevated right side view of the sheet-conveying device of FIG. 8 with the 90° idler rolls engaged.
Figure 11:
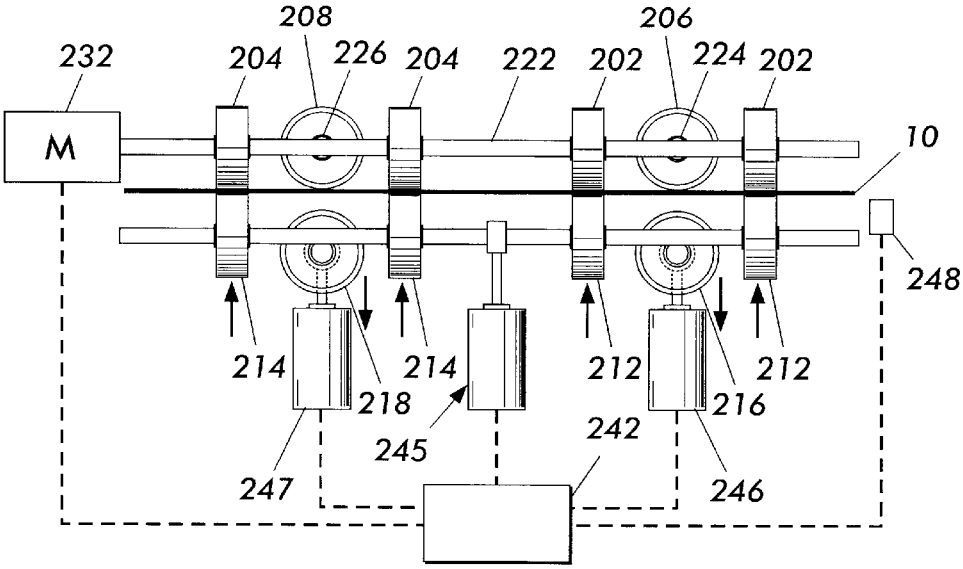
FIG. 11 is a schematic elevated front view of the sheet-conveying device of FIG. 8 with the 0° idler rolls engaged.
Figure 12:
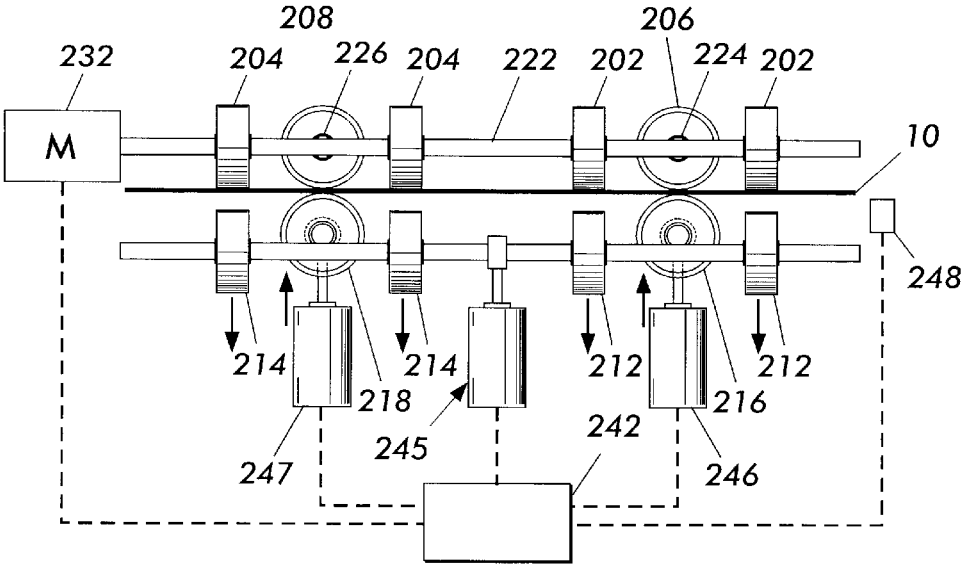
FIG. 12 is a schematic elevated front view of the sheet-conveying device of FIG. 8 with the 90° idler rolls engaged.

A sensor 248 that is operably connected to the controller 242 informs the controller when both sheets have exited the sheet-conveying device. The second sensor 248 may be located at an exit point of the sheet direction changer as shown in FIGS. 8, 11, and 12 or the sensor 248 may be located at the entrance to the finisher. The sensor 248 can sense the TE or the lead edge of the second sheet of paper as it passes. As soon as the second sheet is out from between the 0° nips, the controller 242 causes the 90° actuators (246, 247) to disengage and retract the 90° idler rolls (216, 218) while at the same time causing the actuator 245 to reengage the 0° idler pairs (212, 214) and ramping up the 0° servo 232 to accept the next two sheets entering the sheet conveying device.

The absence of a registration wall in each of the above embodiments reduces the possibility that sheets will be damaged during a direction-changing or sequencing process.

The embodiments disclosed above also allow the user the option of having sheets pass straight through the sheet conveying device without a 90° direction change, which is not possible with sheet conveyers that used a fixed registration wall. This is especially beneficial for the two-up embodiment when customers do not want to slit the larger sheet and just want to stack it. The larger unslit sheet could pass straight through the sheet conveying device having multiple outputs and be in the proper orientation (long edge first) for most finishing or stacking devices. A user would send a command to the controller 242 informing it that a large sheet or large sheets were being printed. The controller 242 would cause the 0° servo to keep drive roll pairs (202, 204) rotating to keep driving the single large sheet forward. The 90° drive rolls would not be used when large sheets passed through the sequencer.

This two-up embodiment also allows for drive roll pair 206 and drive roll pair 208 speeds to be reversed so the system could be used to drive sheets out 90° out the other side of the sheet conveying device having multiple outputs. This is beneficial in the case where a customer location better lends itself to a 90° turn heading left rather than right when looking at the input of the sheet-conveying device having multiple outputs. More generally, the sequencer allows all manner of configurations, cross-shaped, L-shaped, reverse L-shaped, etc.

Figure 13:
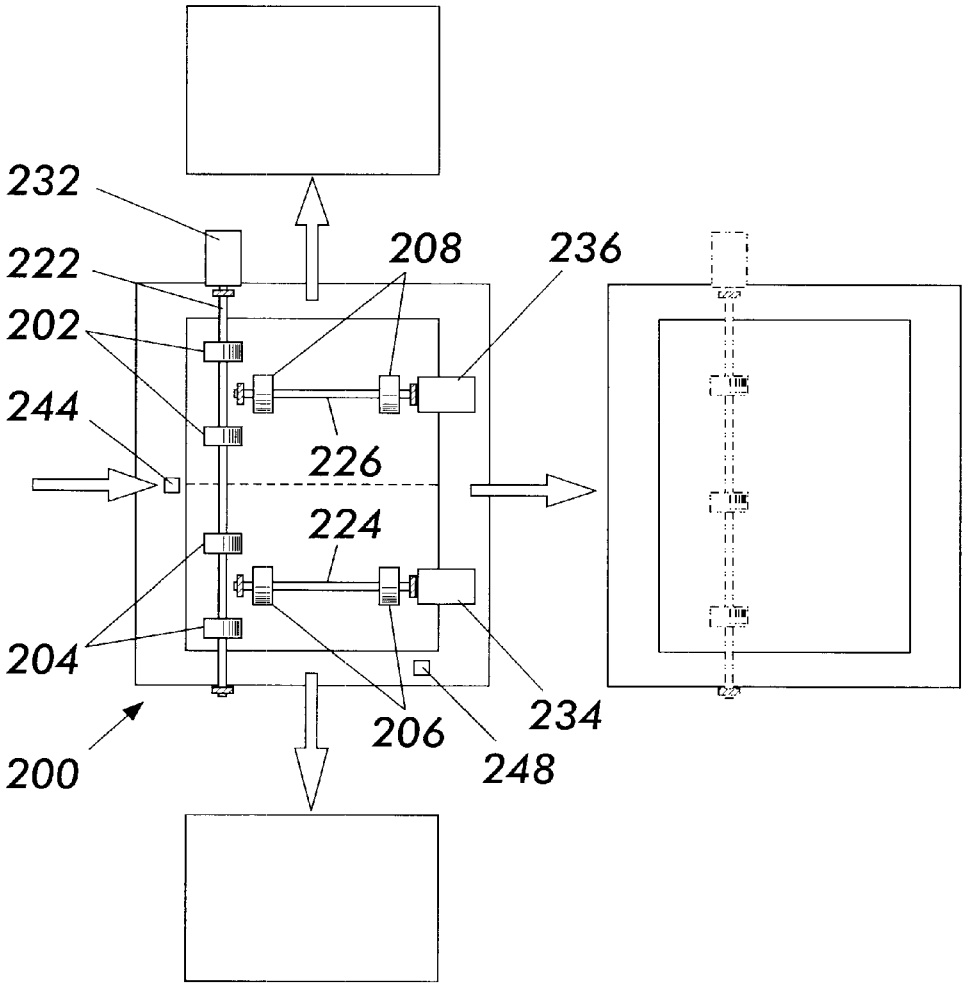
FIG. 13 is a schematic top view of still another embodiment of a sheet-conveying device having multiple outputs.

One embodiment allows sheets to be driven out in directions 90° left and right to the entrance direction as well as forward. This embodiment is illustrated in FIG. 13. In this embodiment, the 90° drive roll pairs (206, 208) rotate in opposite directions to each other. Each pair then drives one sheet of a two-up pair out to a finishing device. Alternatively, a single large sheet entering the sheet-conveying device can be driven straight ahead by the 0° drive roll pairs (202, 204). In this configuration, the conveyer allows sheets to go in any of three different directions—forward, clockwise, or counterclockwise.

This arrangement is beneficial for a number of reasons. For example, a user can greatly increase output rates for two-up prints. Two stackers located to the left and right of the sheet conveying device can stack sheets faster than a single stacker located to the left or right of the sheet conveying device. Alternatively, instead of printing more rapidly, print output could be maintained at the same speed. This configuration could aid in relieving stress on the stackers or third party finishing equipment. Each stacker would see half as many sheets as it would if both sheets were driven in the same direction. This allows more time for the stacking function to occur and allows more time for the sheets to settle in each stack before the next sheet-enters. The same effect would be seen using any third party finishing equipment connected to both output ports. Also, by allowing output to go in any of three directions, a user can now enable three different finishing processes without having to change the machine configuration. Thus, a stacker may be located in one direction, a signature booklet maker in a second direction, and a binder in a third direction. Or a small sheet stacker may be located to the left of the sheet conveying device, a large sheet stacker located directly opposite the paper feed side of the device, and a stitcher may be located off the right side. This allows for maximum flexibility for the customer.

While the present invention has been described in connection with specific embodiments thereof, it will be understood that it is not intended to limit the invention to these embodiments. On the contrary, it is intended to cover all alternatives, modifications, and equivalents as may be included within the spirit and scope of the invention as defined by the appended claims.

What is claimed:

1. A multi-path sheet conveying device having multiple outputs, comprising:

a first sensor located for detecting when the trailing edge of the first sheet passes the first sensor;

a controller operably connected to the first sensor;

a first shaft;

a first pair of rolls rotatably connected to the first shaft;

a first servomotor operably connected to the first shaft and to the controller, wherein the first servomotor rotates the first shaft;

a second shaft oriented at an angle approximately 90° relative to the first shaft;

a second pair of rolls rotatably connected to the second shaft, a second servomotor operably connected to the second shaft and to the controller, wherein the second servomotor rotates the second shaft.

2. The device of claim 1 further comprising a second sensor connected to the controller, wherein the second sensor detects when the leading edge of the sheet passes the second sensor.

3. A method of changing the direction of travel of a sheet exiting a device without using a registration wall and without rotating the sheet, comprising:

sensing a trailing edge of the sheet;

accelerating the sheet in a first direction in response to sensing the trailing edge of the sheet;

decelerating the sheet;

accelerating the sheet in a second direction oriented approximately 90° to the first direction;

wherein the sheet has not been rotated.

4. The method of claim 3, wherein the sheet is stopped such that it will be center registered upon entering a finishing module.

5. The method of claim 3, wherein the sheet is stopped such that it will be inboard registered upon entering a finishing module.

6. The method of claim 3, wherein the sheet is stopped such that it will be outboard registered upon entering a finishing module.

7. A sheet conveying device having multiple outputs for sequencing two approximately identical sheets, each sheet having a leading edge and a trailing edge, wherein the sheets arrive in a two-up configuration without being rotated, comprising:

a first sensor located for detecting when the trailing edge of the first sheet and the trailing edge of the second sheet pass the first sensor;

a controller operably connected to the first sensor;

a first shaft;

a first pair of rolls rotatably connected to the first shaft;

a second pair of rolls rotatably connected to the first shaft;

a first servomotor operably connected to the first shaft and to the controller, wherein the first servomotor rotates the first shaft;

a second shaft oriented at an angle approximately 90° relative to the first shaft;

a third pair of rolls rotatably connected to the second shaft, a second servomotor operably connected to the second shaft and to the controller, wherein the second servomotor rotates the second shaft;

a third shaft oriented at an angle approximately 90° relative to the first shaft and approximately parallel to the second shaft;

a fourth pair of rolls rotatably connected to the third shaft;

a third servomotor operably connected to the third shaft and to the controller, wherein the third servomotor rotates the third shaft.

8. The device of claim 7, wherein the third pair of rolls and the fourth pair of rolls rotate in the same direction.

9. The device of claim 7, wherein the third pair of rolls and the fourth pair of rolls rotate in opposite directions.

10. The device of claim 7 further comprising a second sensor connected to the controller, wherein the second sensor detects when the leading edge of the second sheet passes the second sensor.

11. A method of changing the direction of travel of first and second sheets exiting a device in a two-up configuration without using a registration wall, comprising:

sensing a trailing edge of the first sheet and a trailing edge of the second sheet;

accelerating the first sheet in a first direction between a first pair of drive rolls and a first pair of idler rolls when the trailing edge of the first sheet is sensed;

accelerating the second sheet in the first direction in tandem with the first sheet between a second pair of drive rolls and a second pair of idler rolls;

decelerating the first sheet and the second sheet until each of the first sheet and the second sheet substantially stop traveling in the first direction;

retracting the first pair and the second pair of idler rolls;

extending a third pair and a fourth pair of idler rolls;

accelerating the first sheet to a first speed in a second direction oriented approximately 90° to the first direction between a third pair of drive rolls and the fourth pair of idler rolls;

accelerating the second sheet to a second speed in a third direction between a fourth pair of drive rolls and the fourth pair of idler rolls.

12. The method of claim 11, wherein the third direction is the same as the second direction.

13. The method of claim 12, wherein the first speed is greater than the second speed, and further comprising sensing when a leading edge of the second sheet approaches the fourth pair of drive rolls;

accelerating the second sheet so that it travels at the first speed after sensing when the leading edge of the second sheet approaches the fourth pair of drive rolls.

14. The method of claim 11, wherein the third direction is opposite the second direction.

15. The method of claim 11, wherein the first sheet and the second sheet are stopped such that they will be center registered upon entering a finishing module.

16. The method of claim 11, wherein the first sheet and the second sheet are stopped such that they will be inboard registered upon entering a finishing module.

17. The method of claim 11, wherein the first sheet and the second sheet are stopped such that they will be outboard registered upon entering a finishing module.

18. The method of claim 11, wherein a first servomotor accelerates the first pair of drive rolls and the second pair of drive rolls.

19. The method of claim 18, wherein a second servomotor accelerates the third pair of drive rolls.

20. The method of claim 19, wherein the fourth pair of drive rolls is accelerated by a third servomotor.

* * * * *